United States Patent [19]

McGourty et al.

[11] Patent Number: 4,736,970

[45] Date of Patent: Apr. 12, 1988

[54] ELECTRICALLY CONTROLLED DOOR LOCK

[76] Inventors: Thomas K. McGourty, 9570 Chimney Rock Rd.; Lawrence R. McGourty, 6680 Linne Rd., both of Paso Robles, Calif. 93446

[21] Appl. No.: 23,144

[22] Filed: Mar. 9, 1987

[51] Int. Cl.[4] ..... F05R 13/00

[52] U.S. Cl. ..... 292/359; 70/283; 70/467; 70/469

[58] Field of Search ..... 70/283, 277, 224, 210, 70/282, DIG. 3, 467, 469, 473, 471, 480, 470; 292/359, 144, 153, 169.18, 169.14

[56] References Cited

U.S. PATENT DOCUMENTS

| | | | |
|---|---|---|---|
| 1,378,200 | 5/1921 | Stolberg | 70/210 |
| 1,447,852 | 3/1923 | Huttemann | 70/470 |
| 1,611,838 | 12/1926 | Malicki | 70/283 |
| 1,833,572 | 11/1931 | Hardesty | 70/283 |
| 2,162,048 | 6/1939 | Askew | 292/144 X |
| 2,242,508 | 5/1941 | Ching | 292/169.18 |
| 2,264,420 | 12/1944 | Voight | 292/359 |
| 2,271,966 | 2/1942 | Baribault | 292/144 X |
| 2,650,123 | 8/1953 | Hopgood | 70/473 X |
| 2,834,194 | 5/1958 | Schlage et al. | 70/479 |
| 3,894,417 | 7/1975 | Taniyama | 70/156 |
| 3,939,315 | 2/1976 | Schlage | 200/61.64 |
| 3,967,846 | 7/1976 | Schlage | 292/359 |
| 4,073,527 | 2/1978 | Schlage | 292/144 X |
| 4,390,197 | 6/1983 | Butts | 292/144 |
| 4,676,083 | 6/1987 | Sedley et al. | 70/277 X |

FOREIGN PATENT DOCUMENTS

| | | | |
|---|---|---|---|
| 1263406 | 5/1961 | France | 292/359 |

*Primary Examiner*—Lloyd A. Gall
*Attorney, Agent, or Firm*—Fred N. Schwend

[57] ABSTRACT

A latch bar is connected to the plunger of a solenoid and is movable endwise to release an exterior knob spindle to enable the spindle to actuate a latch bolt retractor. A latch carried by the latch bar is held by the retractor to maintain the latch bar open until the retractor is later actuated by the spindle, thereby enabling a single electric pulse to effect release of the lock bar.

5 Claims, 1 Drawing Sheet

ELECTRICALLY CONTROLLED DOOR LOCK

BACKGROUND OF THE INVENTION

1. Field of the Invention

This invention relates to locks and has particular reference to electrically controlled door locks such as those controlled from a remote point or those controlled by a magnetic card or a push button combination in which buttons must be pressed in a predetermined order to effect release of the lock.

2. Description of the Prior Art

Door locks, particularly of the key controlled type,, are generally of a standard size and fit in a standard size opening in a door. Thus, they are usually interchangeable.

On the other hand, electrically controlled locks are of particular advantage in high security situations, hotels, etc., where keys used to open the usual key locks may be readily copied, or the locks may be readily picked, to enable unauthorized access to otherwise secured locations. However, electrically controlled locks, either of the remotely controlled type or the push button combination type, are generally quite bulky and of a larger size, requiring special door lock openings, so that they are not easily interchangeable with key locks. Furthermore, electrically controlled locks generally require relatively large electric power supplies, thus rendering it impractical to provide a self contained lock unit with batteries incorporated therein or on the door, but require instead, electrical power from an external source.

In our copending application, Ser. No. 07/026,307, filed Mar. 16, 1987, we have disclosed and claimed an electrically controlled lock which requires only low powered electrical pulses for operation and thus enables the use of miniature so called AA batteries or the like. This allows the lock unit to be mounted as a self-contained unit on a door. Although such lock unit is very satisfactory and is applicable to many different locking applications, it requires two electromagnetic devices and associated circuitry for operation.

SUMMARY OF THE INVENTION

Accordingly, a principal object of the present invention is to provide a simple and inexpensive electrically controlled door lock unit which is self contained.

Another object is to provide an electrically controlled lock unit which uses a minimum amount of electric current so that miniature batteries can be used as a power source.

Another object is to provide an electrically controlled lock which will fit within a standard size key lock door opening.

Another object is to provide an electric lock control device which can be incorporated in a standard commercially available lock mechanism with a minimum of modification.

According to the invention, and in a door lock unit of the type comprising a pair of coaxially extending interior and exterior door knob spindles, each effective to actuate a lock bolt retractor independently of the other, a novel electrical lock control is provided comprising a locking element urged endwise of the exterior knob spindle by a light spring to lock the latter spindle against rotation. The locking element is pivotally connected to the plunger of a solenoid mounted in the interior knob spindle. When the solenoid is energized, the locking element is withdrawn from locking engagement with the exterior knob spindle and a latching element pivotally carried by locking element snaps into latching engagement with the retractor. When the exterior knob spindle is rotated, the retractor releases the latching element permitting the spring to return the locking element to locking condition.

Thus, only a single pulse is required to control the lock, enabling the use of miniature batteries which can be mounted directly with the door lock in a self contained unit.

BRIEF DESCRIPTION OF THE DRAWINGS

The manner in which the foregoing objects of the invention are accomplished will be readily understood on reference to the following specification when read in conjunction with the accompanying drawing, wherein.

DESCRIPTION OF THE PREFERRED EMBODIMENT

Figure 1:
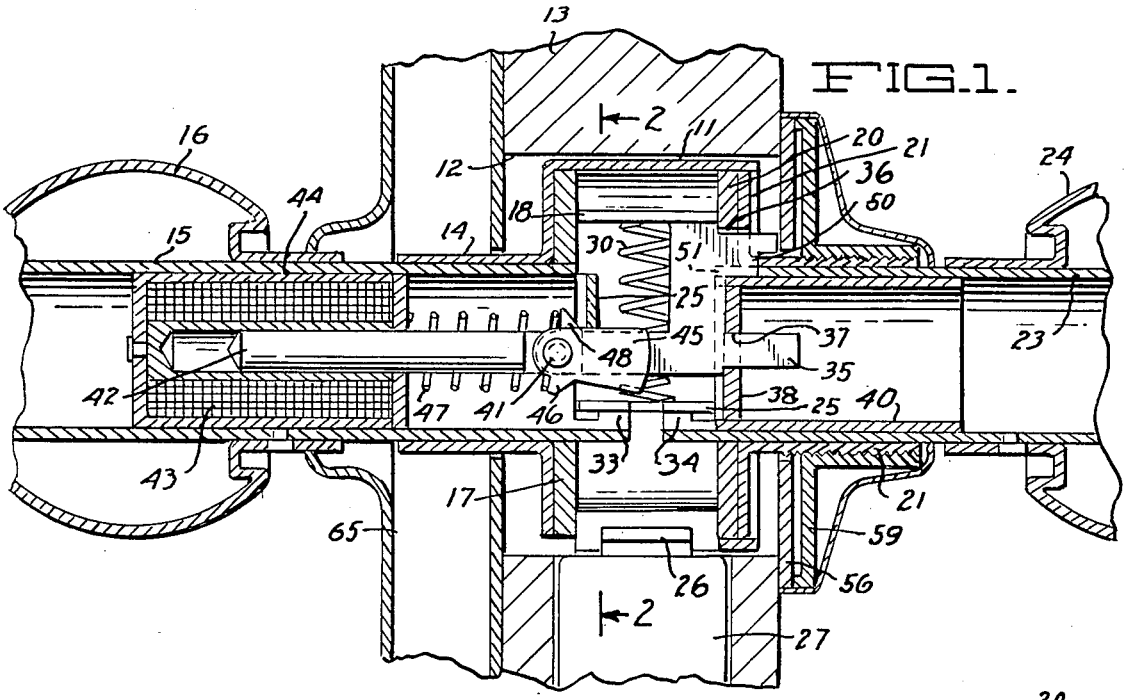
FIG. 1 is a sectional plan view of a door lock embodying a preferred form of the present invention and showing the same mounted in a door.

While this invention is susceptible to embodiment in many different forms, there is shown in the drawing, and will be described, a certain embodiment, with the understanding that the present disclosure is to be considered as an exemplification of the principles of the invention and is not intended to limit the invention to the embodiment illustrated. The scope of the invention, will be pointed out in the appended claims.

Referring to the drawings, parts of the basic lock mechanism disclosed therein are found in a commercially available door lock manufactured by Schlage Lock Co. and basically disclosed, for example, in U.S. Pat. No. 2,834,194 issued on May 13, 1958. Also parts of the basic lock mechanism not specifically disclosed herein may be found in my aforementioned pending application.

The basic lock mechanism comprises a cylindrical lock frame or body 11 arranged to fit within a standard size lock bore 12 in a door 13 and suitably secured therein. The frame is reduced in diameter at one end 14, to form a bearing for a tubular interior knob spindle 15 to which an interior knob 16 is suitably attached, the knob being located on the interior side of the door.

Figure 2:
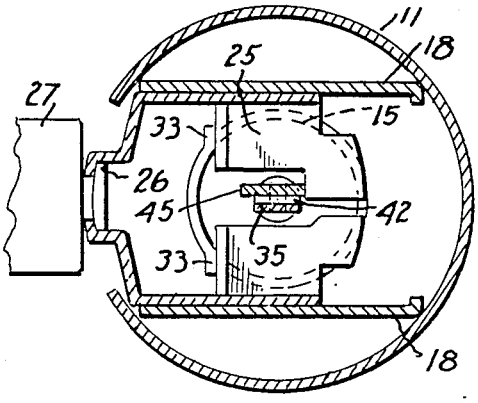
FIG. 2 is a transverse sectional view of the lock and is taken along the line 2—2 of FIG. 1.

An annular wall 17 is suitably secured to the frame 11 at one end of the latter and forms a part thereof, along with a cross member 18 (FIGS. 1 and 2).

A second annular wall member 20 is suitably attached to the opposite end of the cross member 18 and has a flanged hub 21 suitably secured to it. The hub 21 forms a bearing for rotatably supporting a tubular exterior knob spindle 23 for rotation about an axis coincident with the axis of the interior spindle 15. An exterior door knob 24 is suitably attached to the spindle 23.

A roll-back or lock bolt retractor slide 25 is slidably supported by the cross member 18 and is connected at 26 to a latch bolt 27. Compression springs, one of which is shown at 30, interposed between a part of the cross member 18 and a part of the slide 25, cause the latter to normally hold the latch bolt 27 in locked condition wherein it engages with the usual strike plate (not shown) to lock the door 13 in closed condition.

Camming ears 33 on the interior knob spindle 15 are effective, on rotation of the spindle in either direction, to retract the slide 25 against the action of the springs 30 to withdraw the bolt 27 to allow opening of the door. Similarly, camming ears, one of which is shown as 34, on the exterior knob spindle 23 are effective on rotation of the spindle in either direction, to withdraw the bolt 27.

In accordance with the present invention, an electrically controlled lock bar 35 is provided to normally lock the exterior knob spindle 23 from rotating while allowing free rotation of the interior knob spindle 15.

The lock bar 35 is movable lengthwise of the spindles 15 and 23 and is guided by a slot 36 formed in frame wall 20 and by a round hole 37 formed in an end wall 38 of a tube 40 secured in the outer spindle 23.

The lock bar 35 is loosely connected by a pivot pin 41 to the plunger 42 of a solenoid 43, the latter being housed within magnet case 44 secured, as by adhesive, within the inner spindle 15.

A latch pawl 45 is pivotally supported by the pin 41 and has an arm 46 engaged by a relatively light compression spring 47 surrounding the plunger 42 to urge the pawl counter clockwise in engagement with a part of the retractor slide 25. The pivotal connection provided by pin 41 allows for any slight misalignment of the spindles 15 and 23 and thus prevents any binding forces from occurring which might otherwise restrict movement of the lock bar 35 by the weak spring 47. Spring 47 also engages an arm 48 on the lock bar 35, urging the same into its locking position shown in FIG. 1 wherein a locking shoulder 50 thereon engages in a slot 51 in exterior spindle 23 to lock the spindle from rotation by the exterior knob 24.

Figure 3:
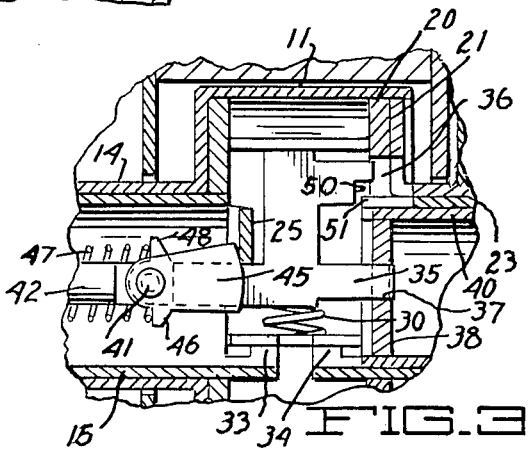
FIG. 3 is a sectional plan view similar to FIG. 1, but partly broken away and showing parts in alternate positions.

Upon application of an electrical pulse to the solenoid 43, its plunger 42 will draw the lock bar 35 to the left until its locking shoulder 50 recedes from the slot 51 in spindle 23, as seen in FIG. 3. At this time, the pawl 45 snaps behind the retractor 25 to hold the lock bar 35 in its unlocking position, permitting rotation of the knob spindle 23.

Upon rotation of the exterior knob 24, the retractor slide 25 will be moved rearwardly (to the right in FIG. 2) to withdraw the latch bolt 27 from locking condition, and at the same time, the slide will recede from engagement with the pawl 45, allowing the spring 47 to again return the latch bar 35 to the right (in FIG. 3) into engagement with the left end of the spindle 23.

The relatively strong retractor springs 30 will be effective, through the retractor slide 25, to return the knob spindle 23 and exterior knob 24 from their rotated positions and in doing so the spindle slot 51 will become aligned with the lock bar 35, permitting the spring 47 to return the lock bar to the right wherein the locking shoulder 50 will reenter and lock in the spindle slot 51.

Figure 4:
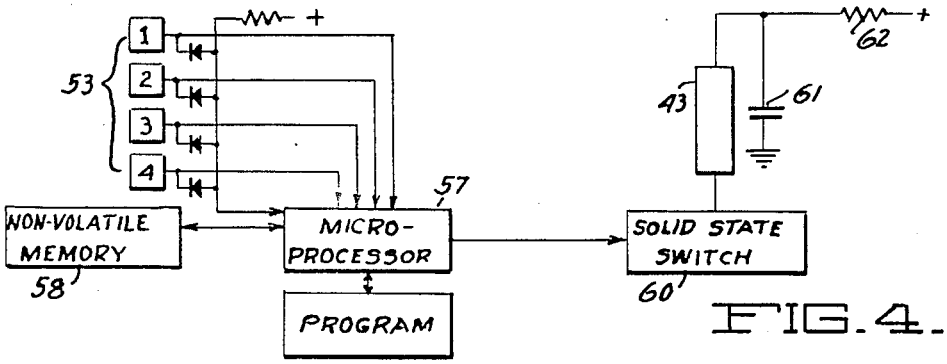
FIG. 4 is a schematic view showing an electric circuit for controlling the lock.

Referring to the schematic electrical diagram of FIG. 4, the present embodiment is disclosed in association with a combination push button system for pulsing or momentarily energizing the solenoid 43.

Four push button switches 53 are provided to be mounted in a manner not shown on a plate 56 (FIG. 1) located on the exterior side of the door and forming part of the lock. The plate 56 is held against the side of the door by an escutcheon member 59 screw threaded on the hub 21.

The switches must be closed in proper sequence in accordance with a predetermined code.

Upon closing a first switch 53, a microprocessor 57 will be activated to scan those switches which are being closed and to compare the code thus set up with a code stored in a memory 58. When a comparison is reached, a solid state switch 60 is activated to momentarily energize the solenoid 43. In order to reduce the drain on the power supply to a minimum, a capacitor 61 is connected in circuit with the solenoid. The capacitor is charged through a current limiting resistor 62. Thus, the capacitor is quickly discharged through the solenoid to provide a momentary high current pulse.

From the foregoing, it will be noted that only a single electrical pulse will be required to effect release of the exterior spindle 23 to enable retraction of the latch bolt 27 by rotating the exterior knob 24. Also, since the electrical pulse is applied to the solenoid when the comparison spring 47 is extended and is therefore in its weakest condition, and since the plunger 42, lock bar 35 and pawl 45 are movable together in a straight line, as a unit, little resistance to movement is encountered and only a small amount of current is needed. Accordingly, only miniature batteries, such as the well known 1.5 volt AA batteries, are required and these are housed in a compartment 65 suitably attached to the lock unit on the interior side of the door 13.

Thus, a self-contained electrically controlled door lock is provided which can be mounted in a standard size lock bore formed in the door without any modification of the latter.

We claim:

1. An electrically controlled door lock comprising
- a lock frame for mounting in said door,
- a knob spindle rotatably supported by said frame,
- a lock bolt retractor supported by said frame,
- means on said spindle for actuating said retractor upon rotation of said spindle,
- means for preventing said spindle from rotating including a locking element movable between a spindle locking position and a spindle unlocking position;
- spring means urging said locking element into said locking position,
- electromagnetic means for moving said locking element into said unlocking position,
- a latch carried by said locking element, and
- said spring means urging said latch into engagement with said retractor whereby to latch said locking element in said unlocking position,
- said retractor being effective upon actuation by said spindle to release said latch whereby to enable said spring means to move said locking element to said locking position.

2. An electrically controlled door lock as defined in claim 1 comprising
- means supporting said locking element for movement lengthwise of said spindle, and
- means on said locking element pivotally supporting said latch for movement into latching engagement with said retractor.

3. An electrically controlled door lock as defined in claim 1 comprising
- a second knob spindle rotatably supported by said frame,
- means on said second spindle for actuating said retractor independently of said first mentioned spindle upon rotation of said second spindle, and means on said second spindle supporting said electromagnetic means.

4. An electrically controlled door lock comprising a rotatable door knob spindle, means for preventing said spindle from rotating including a locking element movable lengthwise of said spindle from a spindle unlocking position to a spindle locking position, spring means urging said locking element into said locking position, electromagnetic means including a plunger movable lengthwise of said spindle;

means pivotally connecting said plunger to said locking element whereby energization of said electromagnetic means causes said plunger to move said locking element to said unlocking position, a spring biased latch for latching said locking element in said unlocking position upon movement of said locking element into said unlocking position, and means operable by said spindle upon rotation thereof for releasing said latch whereby to enable said spring means to move said locking element to said locking position.

5. An electrically controlled door lock comprising a lock frame for mounting in said door, an exterior door knob spindle rotatably supported by said frame, an interior door knob spindle rotatably supported by said frame, a lock bolt retractor supported by said frame, means on said exterior spindle for actuating said retractor, means on said interior spindle for actuating said retractor independently of said exterior spindle, a locking element for preventing rotation of said exterior spindle, means supporting said locking element for movement lengthwise of said spindles between a spindle locking position and a spindle unlocking position, spring means urging said locking element into said locking position, solenoid means carried by said interior spindle for moving said locking element into said unlocking position, and a latch pivotally supported by said locking element, said spring means urging said latch into latching engagement with said retractor whereby to latch said locking element in said unlocking position, said retractor being effective upon actuation by said exterior spindle to release said latch.

* * * * *